United States Patent [19]

Reed et al.

[11] Patent Number: 4,515,211

[45] Date of Patent: May 7, 1985

[54] TOOL CABLE FEEDING SYSTEM

[75] Inventors: Michael R. Reed; Daniel E. Hoffman, both of Bakersfield, Calif.

[73] Assignee: Petro Tool, Inc., Bakersfield, Calif.

[21] Appl. No.: 555,143

[22] Filed: Nov. 25, 1983

[51] Int. Cl.[3] ..... E21B 19/08

[52] U.S. Cl. ..... 166/77; 166/385; 226/181; 226/188

[58] Field of Search ..... 166/77, 385, 84, 85, 166/75 R; 226/150, 168, 181, 188, 196

[56] References Cited

U.S. PATENT DOCUMENTS

| | | | |
|---|---|---|---|
| 2,262,364 | 11/1941 | Hugel | 166/77 |
| 2,567,009 | 9/1951 | Calhoun et al. | 166/77 |
| 3,116,781 | 1/1964 | Rugeley et al. | 72/160 |
| 3,363,880 | 1/1968 | Blagg | 254/265 |
| 3,559,905 | 2/1971 | Palynchuk | 242/54 R |
| 4,003,435 | 1/1977 | Cullen | 166/385 |
| 4,307,783 | 12/1981 | Lanmon | 166/379 |

FOREIGN PATENT DOCUMENTS

| | | | |
|---|---|---|---|
| 451837 | 3/1975 | U.S.S.R. | 166/77 |

*Primary Examiner*—Stephen J. Novosad
*Assistant Examiner*—Michael Goodwin
*Attorney, Agent, or Firm*—Dennison, Meserole, Pollack & Scheiner

[57] ABSTRACT

Apparatus for the control of a well fishing line and operable at a location substantially above the wellhead to enable accommodation of cable mounted well tools, line weights, and the like. The apparatus incorporates a cable engaging drive wheel with a reversible hydraulic motor in direct-drive relation with the drive wheel. A pressure roller is in opposed association with the drive wheel and, through a hydraulic cylinder unit, is manipulable to vary the pressure engagement of the cable with the drive wheel for enhanced control of both the introduction and withdrawal of the cable. Both the hydraulic motor and the hydraulic cylinder unit are operable from a remote control station, normally at ground level, for a continuous monitoring of the apparatus notwithstanding its elevated location relative to the wellhead.

3 Claims, 5 Drawing Figures

TOOL CABLE FEEDING SYSTEM

BACKGROUND OF THE INVENTION

In oil well operations the need occasionally arises for the introduction of tools or equipment into a pressurized well for a variety of purposes including internal pressure and temperature surveying, swabbing and removing water, and, most importantly, fishing or the locating and retrieving of broken and/or stuck tools.

The problem of broken and/or stuck tools is particularly bothersome in that unless such tools can be removed through fishing, retrieved by the lowering of grappling equipment by cable through the well, the well must be killed, that is sealed off at the bottom, after which the broke or stuck pieces are removed using drilling equipment. This is an extremely time-consuming and expensive procedure.

A major factor in the operability of the fishing equipment is the ability to move the equipment down the well against the internal pressure. Under ideal circumstances, this can be effected by weighting the cable, mounting weights thereon sufficient to, in conjunction with the weight of the equipment and the cable itself, move the cable downward to the desired location. However, because of a combination of factors including well pressure, cable strength and cable size, this is frequently not possible. Basically, when the well pressure exceeds a certain point, which varies under different circumstances, overcoming the pressure merely by the use of weights on the cable will not work. A factor contributing to this problem is that while the larger the cable used, the greater the weight that can be suspended therefrom and the less likelihood of breakage or loss of the cable down the well, the larger cable, having a greater diameter, presents a substantially greater surface against which the well pressure bears. In other words, the larger the cable, the more the pressure resists its passage into the well.

The above problem cannot be solved solely by the addition of more weights in that the weights are of necessity limited in size to be accommodated within the well pipe. Further, there is normally a limited height between the top of the well, at ground level, and the top of the lubricator wherein the wire is to be fed. It is in this space that both the operational tools and the weights must be attached, and the appropriate connections made.

In order to provide for the introduction of fishing tools and the like in those instances wherein internal pressure makes the use of weights impractical as the sole means for downwardly moving the tool-supporting cable or wire, proposals have been put forth for the use of cable feeding devices which engage and effect a positive downward driving of the cable. The prior art provides for the positive driving of the cable by appropriate drive assemblies or devices which are exemplified in the following patents:

U.S. Pat. No. 2,262,364, Hugel et al, Nov. 11, 1941

U.S. Pat. No. 2,693,858, Osmun, Nov. 9, 1954.

These known devices include a drive wheel driven, through gear reduction means, either manually as in Osmun, or hydraulically directly from the well pressure as in Hugel et al. In addition, each device includes manual means for adjusting pressure rollers to engage the cable against the drive wheel.

Inasmuch as the patented devices require manual control, it appears that they are specifically intended for installation at ground level with the weights being eliminated. Installation of the patented devices at the upper end of a lubricator, which could extend to a height of from thirty to sixty feet, would be highly impractical in light of the necessity for manual control of the components. Utilizing such feed apparatus as the sole means for introduction of the cable against internal pressure requires substantial pressure on the cable over an extended period of time and noticeable wear on both the device and the cable. This could be particularly troublesome when utilizing cables with internal electrical lines which are susceptible to damage by excessive pressure as might be encountered in the gripping and inwardly feeding of the cable.

The reduction gearing associated with the drives of the patented devices produce a relatively slow cable movement which, while possibly practical when feeding unweighted cable, is time-consuming when attempts are being made to open a shut-down well. Similarly, the drives of the patented devices, concerned with the introduction of cable against internal well pressure, appear to lack a capability of performing any significant control function as the cable is withdrawn.

SUMMARY OF THE INVENTION

The present invention proposes a device or system for the power feeding of cable, normally for the introduction of "fishing" tools, into a well having an internal pressure. The ability to effectively introduce such tools against internal pressure for the removal of broken or stuck pieces and the reopening of a well is extremely important in that the only alternative to the "fishing" of the obstructing pieces involves the sealing off of the bottom of the well and the removal of the broken or stuck pieces utilizing drilling equipment, after which the well must be reopened. Not only is such a procedure extremely time-consuming, but the expense involved could run into the hundreds of thousands of dollars.

The apparatus proposed by the present invention includes a cable feeding device which incorporates a drive wheel driven by a hydraulic motor particularly adapted for control from a remote station. Similarly, the apparatus specifically includes a pressure roller which mounts on and is controlled by a reversible hydraulic ram capable of engaging the cable against the drive wheel with variable pressure dictated by the particular circumstances at any given time during operation of the apparatus. This hydraulic ram is also remotely controlled.

The remote control of the components of the apparatus is particularly significant in that the apparatus can be positioned adjacent the upper portion of a lubricator assembly mounted on a wellhead while control is maintained at ground level. This elevated mounting of the feeding apparatus is important in that the power fed cable can be supplied with weights which, while in themselves may be incapable of inwardly introducing the cable with tool thereon, constitute a significant assist to the power feeding of the cable and the control thereof both during the introduction of the cable and during the subsequent retraction thereof.

More particularly, the provision of feed apparatus which allows for the use of weights on the cable substantially reduces the effective length of the cable which will have to be introduced under positive feed of the device. In other words, the presence of cable weights will allow for self inward movement of the cable much sooner than would occur in the absence of such weights. This both reduces wear on the feed apparatus and the cable, and at the same time reduces the time involved, a significant factor when a well is shut down.

Another important aspect of the remotely controlled hydraulic activating system of the present invention is that the operator can constantly vary the pressure against the cable to maintain desired movement of the cable. This pressure sensitivity is significant for several reasons. In a normal operation, the cable will extend many thousands of feet into the ground and, while at first substantial pressure is needed, as more cable is lowered, the weight of the cable itself reduces the pressure requirement. Thus, the ability to reduce the cable engaging pressure against the cable, that is the pressure engaging the cable against the drive wheel, is significant in reduction in wear both on the feeding apparatus and the cable itself.

The ability to maintain constant control over the gripping of the cable is also significant in maximizing the speed of introduction of the cable. For example, once the weight of the cable overcomes the well pressure, the cable will tend to travel faster than it would normally be driven. Therefore, it is important that this situation be quickly ascertained and the cable released from the drive system. The system of the present invention, through its use of cable weights in conjunction with the drive apparatus, enables a more rapid overcoming of well pressure, with the continuous control of the cable gripping pressure on the cable enabling a more effective and a more timely release of this cable gripping pressure.

The present invention also contemplates the incorporation, at the control station, of a hydraulic pressure gauge indicating the exact gripping pressure exerted on the cable at all times. With experience it will be possible to chart the minimum amount of pressure needed for each of the different variables involved, for example well pressure, size of cable, total weight, depth of cable, etc. This in turn will also contribute to the avoidance of unnecessary wear on the apparatus and cable.

With regard to the hydraulic drive motor for the drive wheel, it is contemplated that this be a direct drive which, with the weighted cable contemplated, substantially enhances the speed at which the cable can be introduced as compared to, as an example, the Hugel et al apparatus which utilizes a gear reduction system. The increased speed is significant in directly reducing the down time of the well.

It is also considered significant that the drive wheel motor is reversible in that problems with well pressure also exist as the cable is being withdrawn from the well. Without the feed apparatus in operation, when the cable is brought up to the area where the well pressure overcomes its weight, the well pressure will tend to push the cable toward the top and either bunch it up or blow it out of the top of the well, neither of which would be acceptable. The apparatus of the present invention, through the control system provided therefor, can maintain accurate control of the drive wheel and the gripping pressure exerted on the cable, and thus provide for a controlled ascent of the cable.

It is of further significance that the apparatus of the present invention incorporates a unique guide system whereby the cable can be threaded through the apparatus under field conditions and without requiring disassembly of the apparatus.

Basically, the cable feeding device itself includes a cylindrical housing which, through upwardly and downwardly directed threaded nipples, mount between the upper end of a wellhead lubricator and an overlying oil saver seal assembly. When so positioned, the device is located approximately thirty to sixty feet above ground level, thus enabling access to a substantial length of cable below the device for mounting of not only the operating tools, but also conventional cable weights or sinker bars for an enhanced control of the cable during both the introduction and pulling thereof.

The cable feeding device incorporates a drive wheel directly driven by a reversible hydraulic motor, and a pressure roller operable through a hydraulic cylinder unit for pressure engaging the cable against the drive wheel. This pressure can be varied for an accommodation of differing circumstances including internal well pressure, cable weight, speed of cable movement, etc. Both hydraulic units are controlled from a ground level control station appropriately provided with control valves and pressure regulating gauging means, thus providing the significant combined benefits of an elevated cable engaging and feeding device with readily accessible controls enabling constant monitoring of the operation of the device.

The device itself is specifically provided with internal guide means for a simplified introduction of the cable thereto and between the drive wheel and pressure roller during in situ installation and without requiring disassembly of the cable feeding device.

Other objects, features and advantages of the invention will become apparent from the details of construction and manner of use of the invention as more fully hereinafter described.

DESCRIPTION OF PREFERRED EMBODIMENT

Figure 1:
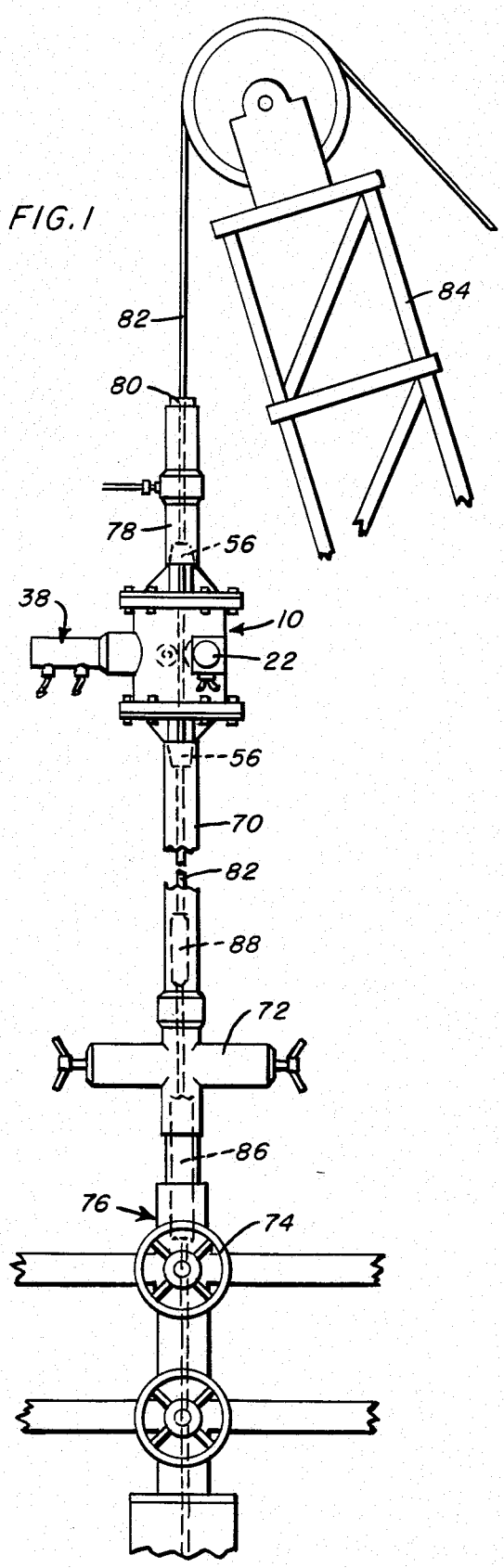
FIG. 1 is a generally schematic illustration of a feed device installed in accordance with the present invention.
Figure 2:
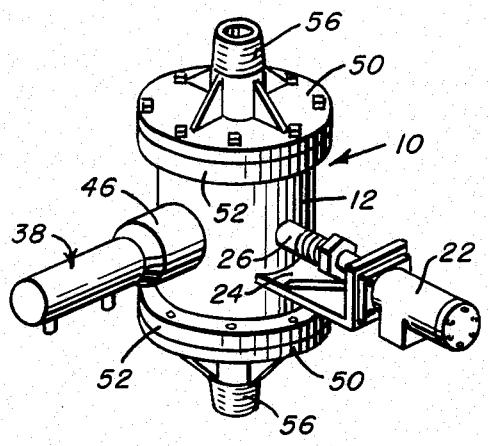
FIG. 2 is a perspective view of the feed device itself.

Referring now more specifically to the drawings, the feed device of the invention is generally designated by reference numeral 10 and includes a support-forming cylindrical housing 12. A pair of plate-like bearing mounts 14 extend generally centrally across the cylindrical housing at mid-height and in laterally spaced relation to each other. The opposite ends of these mounts are rigidly affixed, as by welding, to the interior of the housing 12.

A peripherally grooved drive wheel 16 is positioned between the bearing mounts 14, toward one end thereof, and is mounted on a driving shaft 18 received within a pair of opposed flange bearings 20 affixed to the outer faces of the opposed bearing mounts 16. A reversible hydraulic motor 22 is positioned exteriorly of the housing 12 and affixed to a motor mount 24 welded to the housing. The motor 22 is so oriented as to provide with the pressure connection therethrough to the hydraulic positioning unit including an appropriate pressure regulator 96, a pressure regulator adjustment means 98 and a pressure indicating gauge 100. By such an assembly, it is contemplated that the operator will be able to obtain a continuous showing of the exact amount of pressure exerted on the cable at all times. With this information, and with experience, the operator should be able to chart minimum pressures required for different variables, including well pressure, cable size, total weight, depth of cable, etc. In this manner, the operator can vary the pressure as required to obtain optimal results while avoiding unnecessary wear on the feed apparatus and the cable itself. While the hydraulic positioning unit 38 has been illustrated as provided with a constant source of pressure acting as a return with the controlled or variable pressure solely to one side of the piston, it will be appreciated that this hydraulic positioning unit can be double acting, that is provided with controlled variable pressure for both extension and retraction of the ram.

The cable feeding apparatus, constructed as above detailed and operably positioned for remote control and utilization in conjunction with a weighted cable, provides significant and practical advantages in enhancing the introduction of cables, particularly "fishing" lines in an efficient manner with minimal time consumption and with greatly reduced apparatus and cable wear.

We claim:

1. In a cable feeding system for a well, a cable feed device, said feed device including a cable drive wheel, a gripping roller mounted for selective movement toward and away from said drive wheel for the engagement of a cable against said drive wheel, a hydraulic motor in direct driving engagement with said drive wheel, a hydraulic cylinder unit engaged with said gripping roller for a selective positioning thereof relative to said drive wheel, a remote source of pressurized hydraulic fluid, hydraulic lines communicating said source with said motor and said cylinder unit, and control means controlling flow of pressurized fluid through said hydraulic lines, said control means being located remote from said hydraulic motor and said hydraulic cylinder unit, said cable feed device further including a vertical housing, said housing having a peripheral wall about a central axis and defining upper and lower ends, an upper plate member overlying and closing said upper end, a lower plate member overlying and closing said lower end, each of said plate members defining a central opening therethrough into the housing and generally aligned along the axis of said housing, said drive wheel and said gripping roller aligning to the opposite sides of the housing axis, upper and lower guides each having a cable receiving passage therethrough, said guides extending inward from said plate members with the cable receiving passages aligned with the respective openings, said guides having outer ends fixed to the respective plate members and inner ends aligned along the housing axis at points immediately above and below the drive wheel and gripping roller for the guided passage of a cable therebetween.

2. The system of claim 1 wherein the outer end of the upper guide includes a concavity therein with the corresponding cable receiving passage opening through the bottom thereof, the inner end of said lower guide similarly having a concavity therein with the corresponding passage opening through the bottom thereof, said concavities defining cable directing surfaces.

3. The system of claim 2 including an attaching nipple surrounding each plate-defined central opening and projecting outwardly therefrom.

Figure 3:
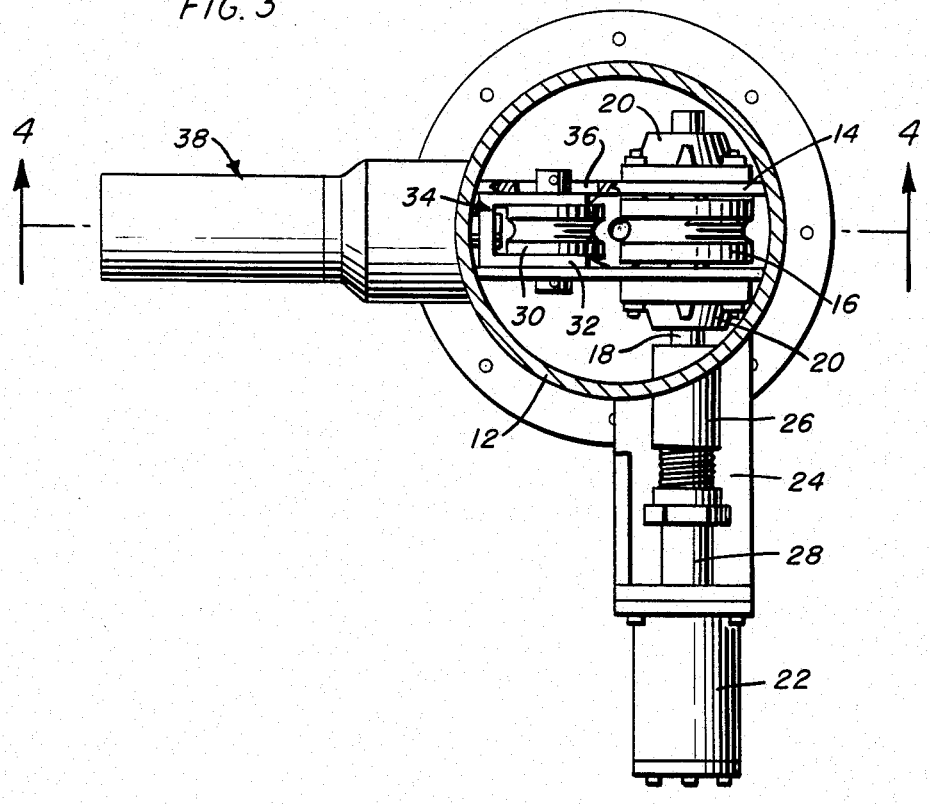
FIG. 3 is an enlarged horizontal cross-sectional view through the feed device taken substantially on a plane passing along line 3—3 in FIG. 4.
Figure 4:
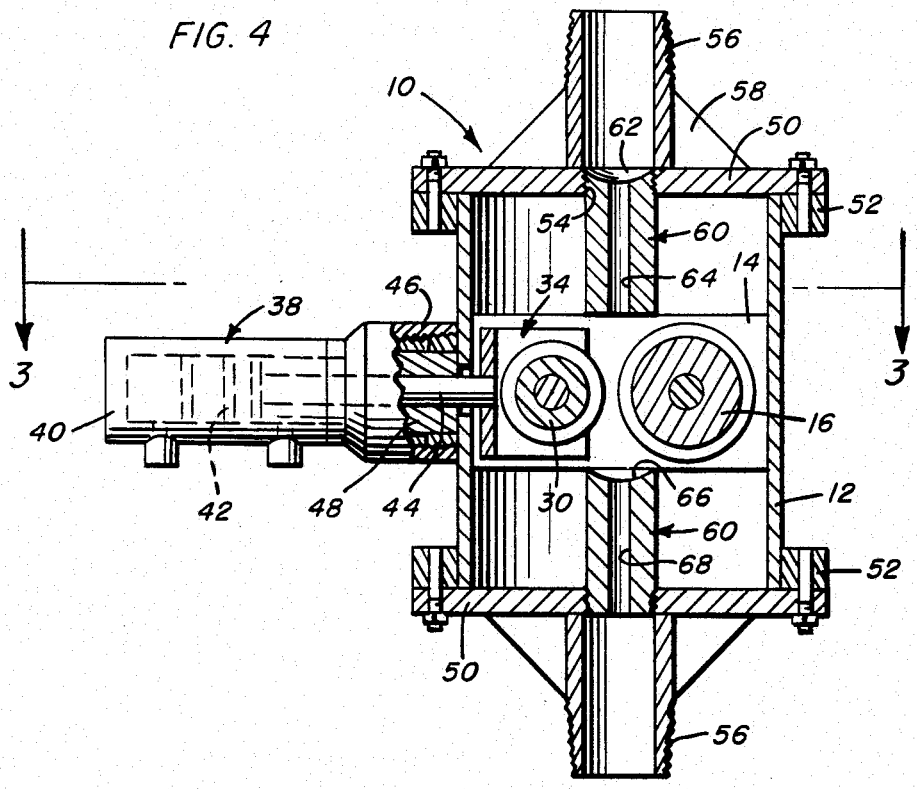
FIG. 4 is a vertical cross-sectional view through the feed device taken substantially on a plane passing along line 4—4 in FIG. 3.

* * * * * for a direct drive of the drive wheel or roller 16. Noting FIG. 3 in particular, the wheel-mounting driving shaft 18 extends through the wall of the housing within an appropriate packing gland 26 and engages the axially aligned motor shaft through coupler 28.

Aligned with the drive wheel 16 is a gripping or pressure clamping peripherally grooved idle roller 30 pin mounted between the arms 32 of a U-shaped yoke 34 slidably positioned between the bearing mounts 14 for a selective movement of the pressure roller 30 toward and away from the drive wheel 16. As will be particularly noted in FIG. 3, the bearing mounts 14 include elongated slots 36 for accommodation of the projecting ends of the pin which mounts the pressure roller 30.

The actual extension and retraction of the pressure roller 30 is effected by a hydraulic positioning unit 38 incorporating a hydraulic cylinder 40 with an internal piston 42 mounting a projecting ram 44, the outer end of which is rigid with the transverse or bight portion of the yoke 34. The hydraulic positioning unit, through an appropriate cylinder mount structure 46, mounts rigidly with the exterior surface of the housing. The ram, passing through an appropriate seal gland 48, extends into the housing and into mounting engagement with the yoke 34. The ram, and hence the gripping roller 30, is capable of both pressure extension and pressure retraction.

The upper and lower ends of the cylindrical housing 12 are closed by plates or disc-like mounting flanges 50 which are, inward of the peripheral edge thereof, bolted to appropriate flange rings 52 welded or otherwise rigidly affixed about the exterior of the housing 14 immediately adjacent the corresponding end. Each of the mounting flanges 50 includes a central opening 54 therethrough coaxially aligned with the opening through the other flange 50 and with the cylindrical housing 12 itself. These openings also align between the drive wheel 16 and the gripping roller 30. An elongated threaded nipple 56 is welded to the outer surface of each of the flanges 50 in surrounding relation to the opening 54 and projects vertically therefrom. Each of the nipples may be stabilized and strengthened by the provision of appropriate braces or gussets 58 between the nipple 56 and the associated mounting flange 50.

Affixed within each of the mounting plate openings 54 is an elongated tubular guide 60 extending inwardly into the housing 12 in coaxial alignment with the nipples 56. Each of the guides 50 terminates at an inner end adjacent the respective upper or lower edges of the bearing mounts 14 centrally therebetween and between the drive wheel 16 and pressure roller 30. The upper end of the uppermost guide 60 includes an upwardly directed concave face 62, the bottom of which communicates directly with an axial cable receiving and guiding bore 64 through the guide 60. This concave upper face 62 is particularly adapted to receive and inwardly guide the end of an introduced cable for introduction through the bore 64 directly, and without any alignment difficulties, between the drive wheel 16 and pressure roller 30. Similarly, the lower guide 60 includes an upper or inner end face 66 also of a concave configuration to receive the cable end, subsequent to passage between the wheel 16 and roller 30, for guided introduction of the cable to the axial passage 68 through the lower guide 60 for a directing of the cable for discharge through the lower nipple 56. Incidentally, as a means for reducing wear on the cable, the drive wheel, pressure roller, and guides may be formed of brass.

In use, the device 10 is specifically intended for mounting at a height sufficiently above the wellhead to allow for an above ground mounting of cable weights and operating tools, as well as for the accommodation of objects removed from the well as a result of the fishing operation. Attention is particularly directed to FIG. 1 which illustrates the cable feeding apparatus 10 mounted, through the lower nipple 56, to the upper end of a lubricator 70 which, when combined with an underlying blowout preventer 72, positions the apparatus 10 approximately 38 feet above the safety gate valve 74 on the wellhead 76. This gate valve 74 is the last valve between the well pressure and atmosphere and constitutes the means for closing off the well while mounting the equipment thereabove.

Mounted immediately above the cable feeding apparatus 10, through the upper nipple 56, is an elongated oil saver seal assembly 78 topped by an uppermost seal 80 through which the cable 82 is initially introduced. The cable, designated by numeral 82, will be conventionally fed over an adjoining rig tower 84 from any appropriate ground mounted supply reel or drum.

The elevated positioning of the feed apparatus 10 is particularly significant in that substantial height is provided above ground level, or more particularly above cut-off valve 74 of the wellhead, to not only accommodate the operating tools 86, but also to provide the cable with sinker weights 88 which, while not in themselves sufficient to downwardly feed the cable under anticipated conditions of high well pressure, do significantly cooperate with the feeding device to achieve the desired downward movement of the cable in a highly efficient manner and without undue wear on the equipment and/or cable itself. As previously indicated, the proper introduction or orientation of the cable through the device 10 is greatly simplified by the provision of internal guide means which receive and properly direct the leading end portion of the cable between the drive wheel and the pressure roller. The tools and weights will normally be mounted at ground level subsequent to passage of the cable through the feed device 10. The lubricator and related structure will subsequently be assembled about the weighted cable and the entire assembly installed above the wellhead, after which the gate valve 74 can be opened.

Figure 5:
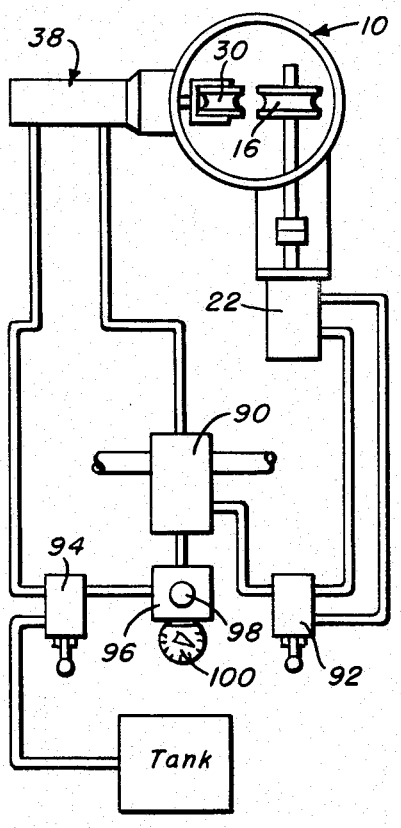
FIG. 5 is a general schematic representation of the control system and means which enable a remote control of the device.

The remote elevated orientation of the feeding apparatus is considered particularly advantageous to maximum utilization thereof in the manner proposed. It is also considered essential that the hydraulic units, and hence the operating components of the apparatus, be continuously monitored and carefully controlled. As such, it is considered particularly significant that the hydraulic units be capable of control from a ground station. Such an arrangement has been generally schematically presented in FIG. 5 wherein an existing hydraulic supply is designated by reference numeral 90. The hydraulic motor 22, which provides a direct reversible drive for the feeding wheel 16, is controlled by a hydraulic throttle valve 92 operable for a reversible forward or reverse driving of the motor 22. As will be appreciated, the reverse driving of the motor is primarily intended as a means for controlling the extraction of the cable during the pulling operation, avoiding an undesirable reaction, in particular, to well pressure as the overall weight of the cable is reduced toward the upper portion of travel thereof.

The hydraulic positioning unit 38 for the gripping roller 30 is controlled through an actuating valve 94